US010472142B2

(12) United States Patent
Presche

(10) Patent No.: US 10,472,142 B2
(45) Date of Patent: Nov. 12, 2019

(54) CLOSURE DEVICE FOR A CONTAINER

(71) Applicant: RPC Bramlage GmbH, Lohne (DE)

(72) Inventor: Martin Presche, Dinklage (DE)

(73) Assignee: RPC Bramlage GmbH, Lohne (DE)

( * ) Notice: Subject to any disclaimer, the term of this patent is extended or adjusted under 35 U.S.C. 154(b) by 0 days.

(21) Appl. No.: 15/769,518

(22) PCT Filed: Oct. 10, 2016

(86) PCT No.: PCT/EP2016/074138
§ 371 (c)(1),
(2) Date: Apr. 19, 2018

(87) PCT Pub. No.: WO2017/067803
PCT Pub. Date: Apr. 27, 2017

(65) Prior Publication Data

US 2018/0305095 A1 Oct. 25, 2018

(30) Foreign Application Priority Data

Oct. 22, 2015 (DE) ..... 10 2015 118 053

(51) Int. Cl.
*B65D 51/28* (2006.01)
*B65D 41/04* (2006.01)

(52) U.S. Cl.
CPC ..... *B65D 51/2864* (2013.01); *B65D 41/04* (2013.01); *B65D 51/2892* (2013.01)

(58) Field of Classification Search
CPC .. B65D 47/242; B65D 51/2857; B65D 41/04; B65D 51/2892; B65D 51/2864; A61J 1/2093
(Continued)

(56) References Cited

U.S. PATENT DOCUMENTS 1,464,273 A * 8/1923 Schopflocher ..... B65D 47/243 206/219
2,331,426 A * 10/1943 Scheemaeker ..... A01J 11/12 206/221
(Continued)

FOREIGN PATENT DOCUMENTS

WO 2007/129116 A1 11/2007
WO 2008/111731 A1 9/2008
WO 2010/114309 A2 10/2010

OTHER PUBLICATIONS

International Search Report of PCT/EP2016/074138, dated Nov. 7, 2016.
(Continued)

*Primary Examiner* — Chun Hoi Cheung
(74) *Attorney, Agent, or Firm* — Collard & Roe, P.C.

(57) ABSTRACT

A closure device for closing a container opening of a container, in particular a drinks bottle, has a lid element, a chamber arranged on the cover element and an inner housing. The chamber and the inner housing have closers and openers corresponding to one another, which interact with one another in such a way that a medium contained in the chamber can move into the container as a result of a movement of the lid element relative to the inner housing. In order to create an alternative closure device, which is particularly simple to produce and can be produced from as few individual components as possible, the closer is a closure pin which is securely connected to the chamber, and which can be removed from a closure opening of the inner housing forming the opener by a movement of the lid element relative to the inner housing.

9 Claims, 4 Drawing Sheets

(58) Field of Classification Search
USPC ..... 206/219–222
See application file for complete search history.

(56) References Cited

U.S. PATENT DOCUMENTS 3,139,121 A * 6/1964 Ballin ..... B65D 51/2857 141/24
3,651,990 A * 3/1972 Cernei ..... B65D 25/087 206/221
4,903,865 A * 2/1990 Janowitz ..... B65D 51/2842 206/222
5,564,600 A * 10/1996 Renault ..... B65D 81/3211 206/221
5,785,044 A * 7/1998 Meador ..... A61B 10/007 206/221
5,992,693 A * 11/1999 Albisetti ..... B65D 81/3211 206/221
6,021,892 A * 2/2000 Baudin ..... B65D 81/3211 206/221
6,022,134 A * 2/2000 Andrews ..... B01F 13/002 206/221
6,994,211 B2 * 2/2006 Cho ..... B65D 51/2864 206/219
7,588,142 B1 9/2009 Bush
7,886,899 B2 * 2/2011 Frutin ..... B65D 51/2892 206/221
8,328,010 B2 * 12/2012 Lee ..... B65D 51/2864 206/221
8,485,353 B2 * 7/2013 Lee ..... B65D 47/243 206/219
9,617,050 B2 * 4/2017 Dreyer ..... B65D 51/2892
2010/0012532 A1 * 1/2010 Frutin ..... B65D 47/242 206/221

OTHER PUBLICATIONS

Response to European Patent Office by German Patent Attorneys in PCT/EP2016/074138 dated Nov. 8, 2017 with English translation of relevant parts.

* cited by examiner

CLOSURE DEVICE FOR A CONTAINER

CROSS REFERENCE TO RELATED APPLICATIONS

This application is the National Stage of PCT/EP2016/074138 filed on Oct. 10, 2016, which claims priority under 35 U.S.C. § 119 of German Application No. 10 2015 118 053.7 filed on Oct. 22, 2015, the disclosures of which are incorporated by reference. The international application under PCT article 21(2) was not published in English.

TECHNICAL FIELD

The invention pertains to a closure device for closing a container opening of a container, particularly a beverage bottle, wherein the closure device features a lid element, a chamber arranged on the lid element and an inner housing, and wherein the chamber and the inner housing feature closing means and opening means that correspond to one another and interact with one another in such a way that a medium enclosed in the chamber can escape into the container due to a motion of the lid element relative to the inner housing.

PRIOR ART

Closure devices of the aforementioned type are known from the prior art. They serve for sealing a container and for simultaneously providing a chamber for the separate storage of liquid or powdery mediums, for example tea essences or the like, such that these mediums do not immediately come in contact with and/or are mixed with the contents of the container, for example water, when the container is filled, but only at the time, at which the closure device is removed from the container. This is typically the time, at which the contents of the container should be consumed.

For example, publication WO 2007/129116 A1 describes a closure device of the aforementioned type, which upon opening a container sealed with this closure device releases a supplemental liquid enclosed in the chamber into the container. The closure device features a lid element, a chamber and an inner housing. The inner housing has a discharge opening, into which a plug element connected to the inner housing engages in a sealed fashion. The lid element and the inner housing are connected to one another by means of screw threads, wherein the lid element can be raised relative to the inner housing from a closed position, in which the plug element seals the discharge opening of the chamber, into a discharging position, in which the plug element is at least partially retracted from the discharge opening, in order to thereby produce a passage from the chamber into the container. In this way, the medium stored in the chamber can escape into the container, where it is mixed with the medium enclosed in the container.

U.S. Pat. No. 7,588,142 B1 discloses a closure device, in which a closing means in the form of a closure cap is provided and connected to an inner wall of the chamber. The chamber is realized in a continuously cylindrical fashion. Furthermore, WO 2008/111731 A1 discloses a closure device, in which a closing means, which is realized in a pin-like fashion on its free end, is arranged directly on a chamber ceiling and only extends in the region of the longitudinal axis of the chamber. With respect to its inner surface, the chamber is realized in a continuously cylindrical fashion. We furthermore refer to the prior art according to WO 2010/114309 A2.

SUMMARY OF THE INVENTION

Based on the above-described prior art, the invention aims to disclose a closure device that has an advantageous design with respect to the closing means and the chamber.

This objective is initially attained in one aspect of the invention where the closing means is a closure pin that is arranged on the chamber and can be removed from a closure opening of the inner housing forming the opening means due to a motion of the lid element relative to the inner housing, and the opening means consist of an opening part that features two circumferential sealing zones, namely a sealing zone that is formed on an outer circumferential surface of the opening means and interacts with an inner surface of the chamber and a sealing zone that is offset inward relative thereto and interacts with the closure pin, wherein the sealing zones are furthermore arranged concentric to one another in a direction extending perpendicular to a moving direction of the opening means relative to the chamber when the closure device is opened.

The above-defined objective is furthermore attained in another aspect of the invention where the closing means is a closure pin, a sealing element is arranged between a sealing end of the closure pin and the closure opening, and an additional sealing element is arranged between an inner surface of a discharge nozzle and an outer surface of a channel dome of the inner housing such that two circumferential sealing zones are formed, wherein said sealing zones are furthermore arranged concentric to one another in a direction extending perpendicular to a moving direction of the opening means relative to the chamber when the closure device is opened.

The closing means, namely the closure pin, is arranged on the chamber whereas the opening means, i.e. the closure opening, is formed on the inner housing. In a closed position of the closure means, the closure pin seals the closure opening in that it either engages into or covers the closure opening. The closure pin is removed from the closure opening when the closure device is opened, i.e. when the lid element is spaced apart from the container—and the chamber is thereby simultaneously displaced relative to the inner housing—such that the medium enclosed in the chamber can flow into the container through the closure opening. During the production of the closure device, the chamber is advantageously inserted into the inner housing concentrically, wherein the closure pin is simultaneously displaced into a position, in which it seals the closure opening. Since the closure pin preferably is rigidly connected to the chamber, it also maintains its position and orientation relative to the chamber during the assembly of the closure device such that the closure pin automatically comes in contact with the closure opening due to the position and orientation on the chamber. The rigid connection is particularly realized in the form of a rigid connection in the axial direction.

The opening means may respectively interact with the chamber on the two concentrically arranged sealing zones. In this context, it is possible to realize an interaction with a closure pin, which preferably is rigidly connected to the chamber, as well as an additional interaction with a receptacle opening for the opening means on the chamber, which is realized such that it surrounds the closure pin.

A medium to be discharged from the chamber is preferably under pressure. If the medium consists of a liquid, a corresponding compressed gas region may for this purpose be provided above a liquid level during the filling process.

A secure seal, which can also be inexpensively realized with respect to the production technology, is particularly important for such a pressurized medium.

Due to the fact that two concentric sealing zones are formed, two circumferential regions, preferably cylindrical regions, can be suitably encompassed in a sealed fashion. This may particularly concern a cylindrical inner surface and a cylindrical outer surface of corresponding regions of the chamber, which are encompassed by the opening means in a sealed fashion.

It is proposed that the closure pin is realized integrally with the chamber. In this context, it is particularly advantageous to jointly produce the chamber and the closure pin by means of a plastic injection molding process such that no separate production step for connecting the closure pin to the chamber is required. An injection molding process can be advantageously utilized in this case because the chamber is usually made of a plastic, for example polybutylene terephthalate (PBT) or also polypropylene (PP) or polyethylene (PE). Due to the integral design of the closure pin on the chamber, its position and orientation relative to the chamber remain constant such that the closure pin is reliably moved into a position, in which it seals the closure opening, when the chamber is connected to the inner housing. As an alternative to this integral design, however, it would basically also be possible to arrange the closure pin on the chamber in a different way. For example, the closure pin may be bonded or welded to the chamber. In this context, it is important to produce a rigid connection between the chamber and the closure pin such that the closure pin cannot be separated from the chamber during the insertion into the closure device.

It is furthermore proposed that the closure pin has a freely projecting sealing end that can be inserted into the closure opening. For example, the closure pin may be arranged on the chamber wall like an L-shaped web such that the free sealing end points in the direction of the closure opening of the inner housing. If the chamber is realized cylindrically, the end region of the closure pin carrying the sealing end is arranged on the longitudinal axis of the chamber.

Different designs of the closure pin would basically also be conceivable. For example, multiple webs arranged in a star-shaped fashion may also radially extend from the inner wall of the chamber to the longitudinal axis, wherein the webs carry the end region with the sealing end in a star-shaped fashion. In this case, the closure pin is advantageously arranged in a section of the chamber, which is tapered relative to the remaining chamber like an outlet region, such that the chamber has a reduced diameter in the region of the closure pin.

In addition, the sealing end advantageously has a diameter that essentially corresponds to the inside diameter of the closure opening. In this case, the outside diameter of the sealing end and the inside diameter of the closure opening are correspondingly realized in such a way that the sealing end can be inserted into the closure opening, if applicable with a sealing element arranged in between. The sealing end is therefore inserted into the closure opening like a plug. If the sealing end is alternatively not inserted into the closure opening, but rather seals the closure opening from outside, it is advantageous to realize the sealing end with a correspondingly larger diameter than the closure opening.

It is proposed to assign a sealing element to the closure opening and/or the closure pin in order to produce a fluid-tight seal between the closure opening and the closure pin. A sealing element for producing a fluid-tight connection between the sealing end and the closure opening is advantageous in instances, in which the sealing end of the closure pin is arranged in front of the closure opening, as well as in instances, in which the sealing end projects into the closure opening. The sealing element may advantageously consist of a rubber seal or the like. This sealing element may either be arranged on an edge region of the inner housing that defines the closure opening, on the sealing end of the closure pin or on the closure opening and on the closure pin.

A sealing element is advantageously assigned to the inner wall of the closure opening, wherein the inner wall is particularly coated with the sealing material. In this context, it is proposed to insert the sealing end of the closure pin into the closure opening such that the sealing element/the coating is arranged in between. Due to the interior coating of the closure opening with a sealing material, it is possible to realize a sealing element that always maintains its position on the closure opening and thereby contributes to optimally sealing the closure opening.

It is furthermore proposed that the closure opening forms part of a flow channel, the length of which corresponds to at least five times its diameter and to no more than twenty times its diameter. The medium being discharged from the chamber therefore has to flow through the flow channel in order to reach the container. In this way, the medium is not discharged from the chamber in a surge-like fashion, but rather in the form of a relatively fine jet over a certain period of time. This ultimately also promotes the superior miscibility of the medium enclosed in the container and the medium being discharged from the chamber. In this case, the sealing end of the closure pin does not have to be inserted into the flow channel over the entire length thereof, but rather may only be inserted into the flow channel in the region of the closure opening, for example, with a section that has a length of a few millimeters. In this way, the process of joining the chamber with the inner housing is simplified because the sealing end or the closure pin does not have to be inserted into the flow channel over a greater length, particularly not over the entire longitudinal extent of the closure pin and/or the flow channel.

BRIEF DESCRIPTION OF THE DRAWINGS

The invention is described in greater detail below with reference to exemplary embodiments. In the drawings.

DESCRIPTION OF THE EMBODIMENTS

A closure device 1 with a chamber 6 that features a lower opening is illustrated in the figures and described below, wherein opening means that make it possible to empty the chamber 6 are provided relative to said lower opening. The opening means particularly consist of an opening part, which in the exemplary embodiment is specifically realized in the form of a sealing element 10. This opening part features two circumferential sealing zones, namely a sealing zone that is preferably formed on an outer circumferential surface of the opening means and interacts with an inner surface of the chamber 6, and an additional sealing zone that is offset inward relative thereto and in the exemplary embodiment interacts with the closure pin 7. The aforementioned sealing zones are arranged concentric to one another in a perpendicular direction—referred to a moving direction R of the opening means relative to the chamber 6 when the closure device is opened.

Figure 1:
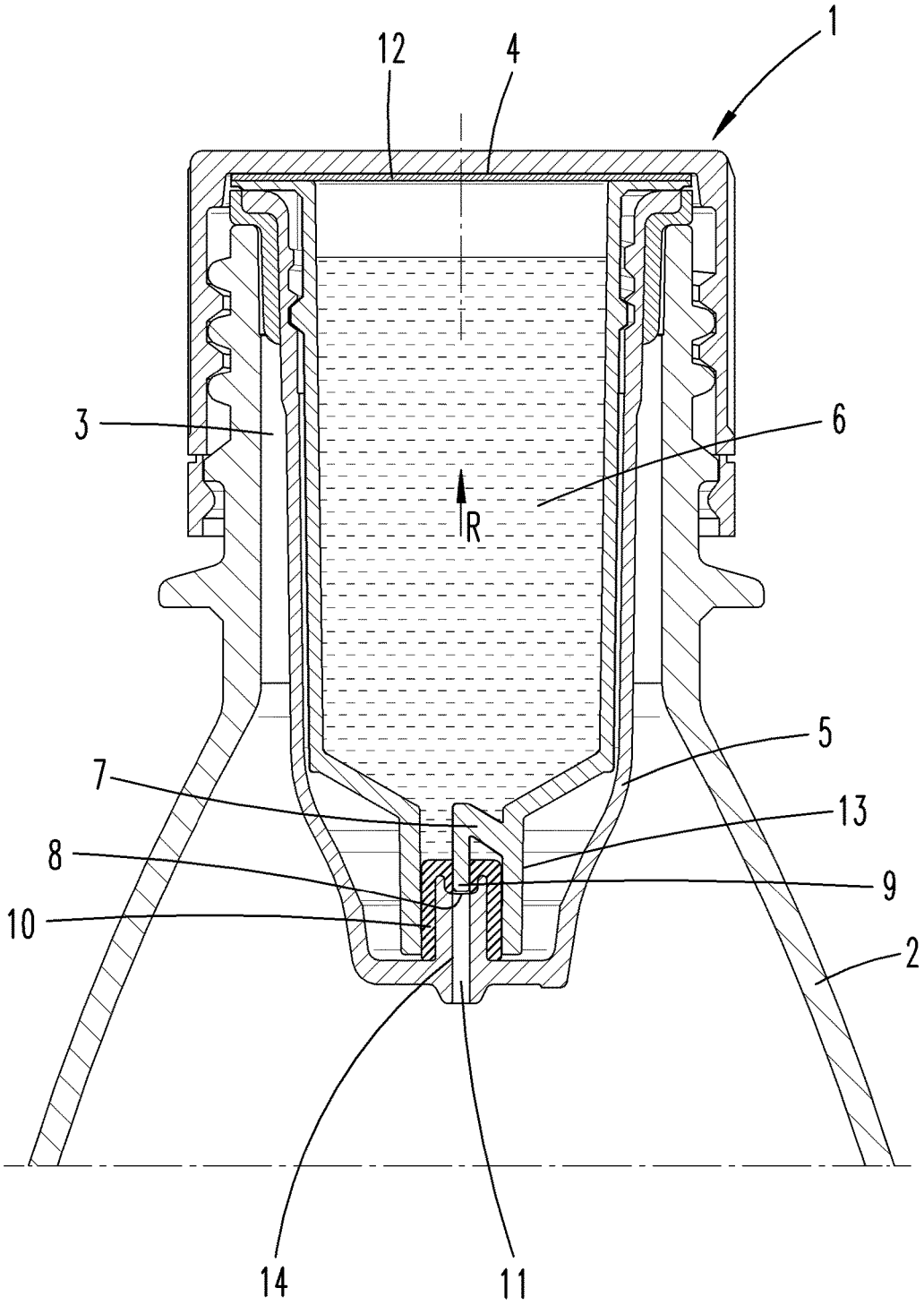
FIG. 1 shows a section of a container with a closure device arranged thereon.

FIG. 1 shows an upper section of a container 2, in this case a beverage bottle, on the container opening 3 of which a closure device 1 is arranged. The closure device 1 is in a position relative to the container 2, in which it seals the container opening 3 in a fluid-tight fashion. The closure device 1 is usually screwed on the container 2 such that the container opening 3 is sealed. In this state, the container 2 can be stored for a prolonged period of time without the contents escaping from the container 2. In order to open the container 2, the closure device 1 is usually unscrewed from the container 2 such that the container opening 3 ultimately is completely opened.

The closure device 1 features a lid element 4, a chamber 6 arranged on the lid element 4 and an inner housing 5. In the—non-restrictive—embodiment shown, the lid element 4 is a plastic lid consisting, for example, of polypropylene (PP) or polyethylene (PE). The chamber 6 is sealed with a foil element 12. This foil element 12 advantageously is an aluminum foil, but may also consist of a plastic material such as, for example, EVOH (ethylene vinyl alcohol copolymer), PET (polyethylene terephthalate) or the like. If the foil element 12 consists of aluminum, it is preferably coated with a varnish for the material of the chamber 6, particularly PBT, on the side that points in the direction of the chamber 6. A varnish suitable for use in conjunction with the lid element 4 is advantageously applied on the opposite side of the foil element 12 that points in the direction of the lid element 4. The foil element 12 preferably is respectively welded to the chamber 6 and the lid element 4. The opening is used for filling the chamber 6 with a medium prior to sealing the chamber 6 with the lid element 4.

The lid element 4 may also consist, for example, of an aluminum lid that is rolled onto the container 2 although such an aluminum lid is not explicitly illustrated in the inventive embodiment. This is particularly advantageous in conjunction with glass containers.

The chamber 6 is connected to the inner housing 5 by means of corresponding threads. The inner housing 5 is pressed into the container 2 in the region of the container opening 3 by means of a compression seal. The lid element 4 and the container 2 furthermore feature corresponding threads, by means of which the lid element 4 is connected to the container 2.

The chamber 6 is preferably realized cylindrically and arranged coaxially within the inner housing 5. The chamber features a closure pin 7, which is realized integrally with the chamber 6 (for example by means of a plastic injection molding process), in the region of its face that points in the direction of the inner housing 5. The closure pin 7 is designed in an L-shaped fashion and extends—starting from the inner wall of the chamber 6—to the longitudinal axis of the chamber 6. The closure pin 7 furthermore has a freely projecting sealing end 9 that lies on the longitudinal axis and points in the direction of a closure opening 8 formed on the inner housing 5.

The closure pin 7 may basically have different shapes. As an alternative to the single L-shaped web shown, it would also be possible, for example, to provide a plurality of webs that radially extend from the chamber axis in the direction of the inner wall of the chamber 6 and position the sealing end 9 on the chamber axis. In this case, flow-through openings, through which the medium enclosed in the chamber 6 can flow out of the chamber 6 in the direction of the inner housing 5, are formed between adjacent webs.

The sealing end 9 of the closure pin 7 can be inserted into the closure opening 8 of the inner housing 5. In this case, the closure opening 8 forms part of a flow channel 11 that is oriented parallel to the longitudinal axis of the closure device 1, as well as to the longitudinal axes of the chamber 6 and the inner housing 5. The flow channel 11 has a length that approximately corresponds to ten times its diameter. The flow channel 11 is arranged within a channel dome 14 formed on a face of the cylindrical inner housing 5, wherein the material thickness of the inner housing 5 is in this region widened in a dome-like fashion in order to define the flow channel 11. The diameter of the closure opening 8 and the flow channel 11 essentially corresponds to the diameter of the sealing end 9 such that the sealing end 9 can be respectively inserted into the closure opening 8 or the flow channel 11 in a sealed fashion. In the exemplary embodiment shown, a sealing element 10 is respectively arranged between the sealing end 9 of the closure pin 7 and the closure opening 8 or the flow channel 11 in order to produce a fluid-tight connection. In the closed state of the closure device 1 shown, the sealing end 9 respectively engages into the closure opening 8 or the flow channel 11 with the sealing element 10 arranged in between such that the medium enclosed in the chamber 6 can no longer flow into the container 2 through the flow channel 11. In this case, the sealing element 10 is realized in the form of a rubber seal, but it would alternatively also be possible, for example, to respectively coat the inside of the closure opening 8 or the flow channel 11 with a sealing material.

In the closed state of the closure device 1 shown, the channel dome 14 protrudes into a discharge nozzle 13 of the chamber 6 over a certain axial length such that the sealing end 9 of the closure pin 7 is respectively engaged with the closure opening 8 or the flow channel 11.

Figure 2:
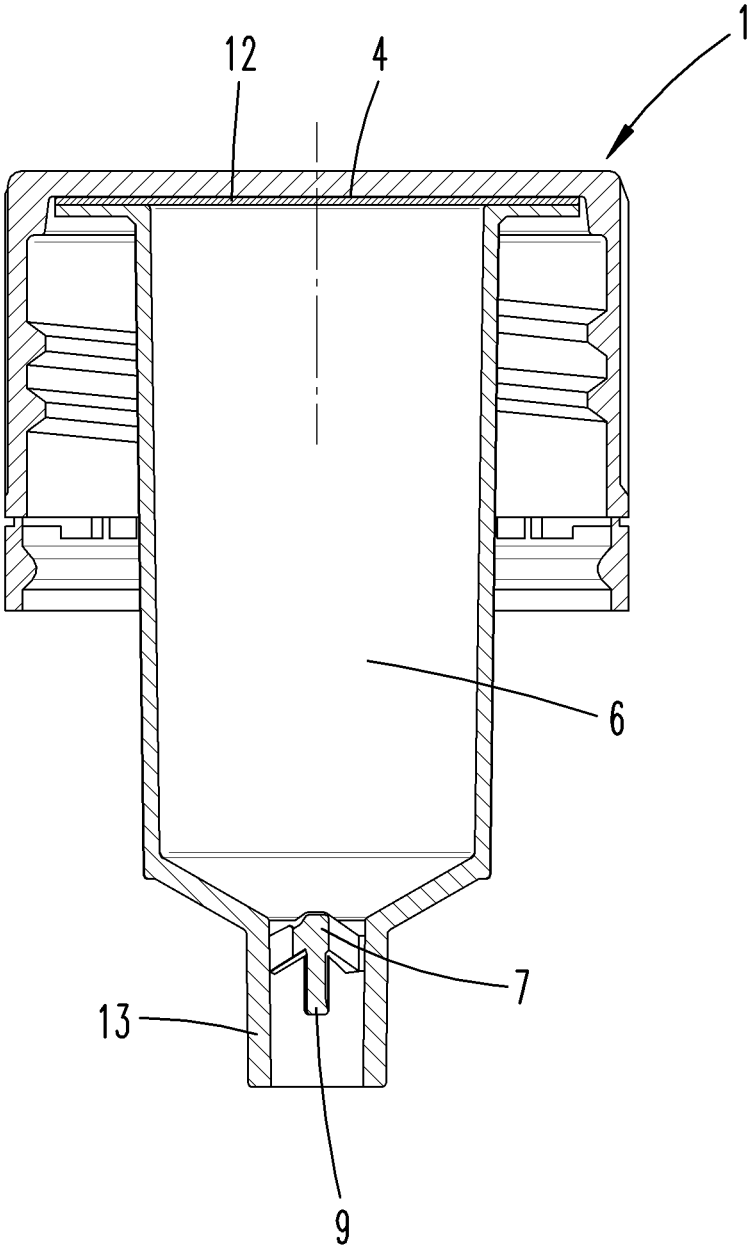
FIG. 2 shows a lid element of the closure device with a chamber arranged thereon.

FIG. 2 shows the chamber 6 in a pre-assembled state on the lid element 4. In this state, the chamber 6 is already sealed with the foil element 2. The discharge nozzle 13 carrying the closure pin 7 is formed on the face of the chamber 6 that points away from the lid element 4. In this case, the closure pin 7 radially extends from the inner wall of the discharge nozzle 13 to the longitudinal axis of the chamber 6 and from there in the direction of its sealing end 9 parallel to the longitudinal axis.

Figure 3:
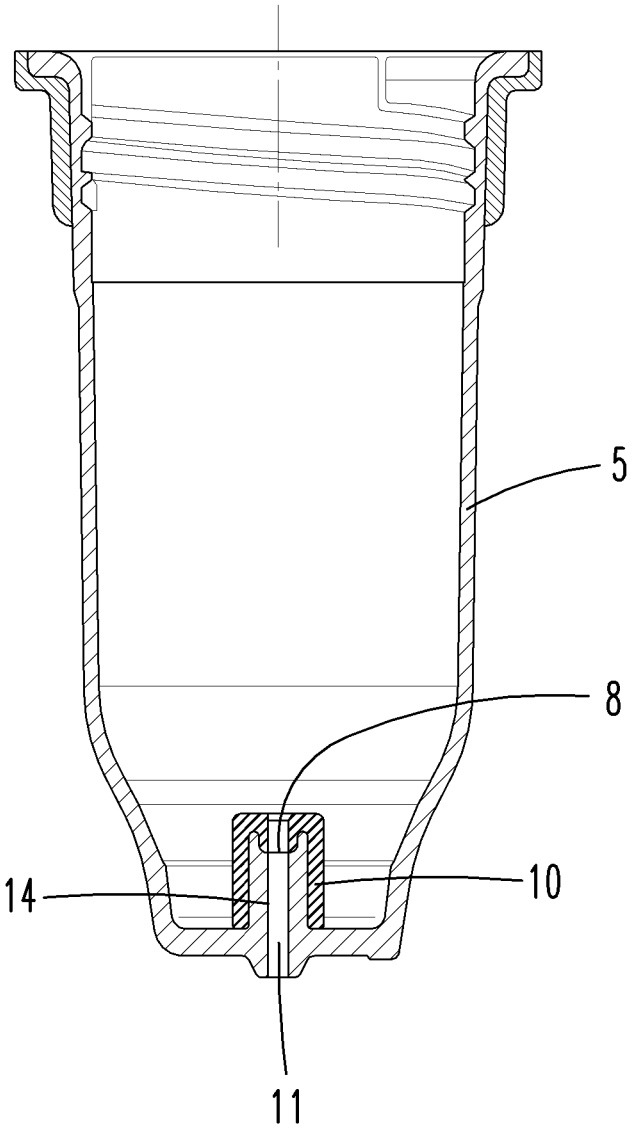
FIG. 3 shows an inner housing of the closure device.

FIG. 3 shows the inner housing 5 of the closure device 1 in a state prior to being joined with the lid element 4 and the chamber 6. The channel dome 14, which respectively features the closure opening 8 or the flow channel 11, is formed on the lower face of the inner housing 5. On the inside of the inner housing 5, the channel dome 14 is covered by the sealing element 10 that at least partially protrudes into the closure opening 8 or the flow channel 11, respectively. In this case, the sealing element 10 consists of a rubber seal that is realized separately of the inner housing 5 and inserted into the inner housing 5 such that it covers the channel dome 14 and at least partially protrudes into the flow channel 11 prior to connecting the chamber 6 to the inner housing 5.

Figure 4:
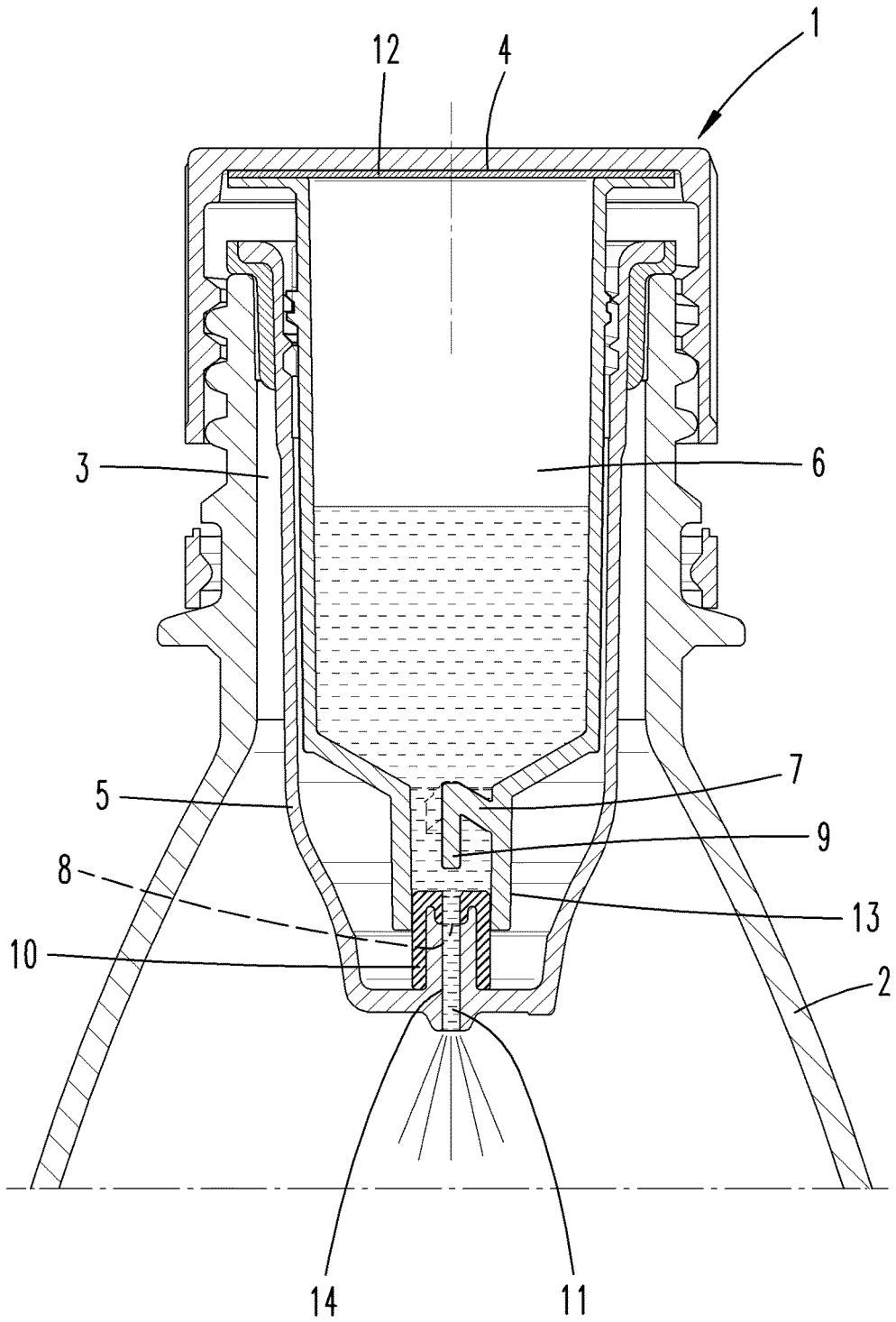
FIG. 4 shows the closure device in a discharging position.

FIG. 4 shows the closure device 1 with the lid element 4, the chamber 6 and the inner housing 5, which is concentrically pushed over the chamber 6 and engages into the lid element 4 with an upper edge region. This figure shows the open state of the closure device 1, in which the chamber 6 and the inner housing 5 are—in contrast to the closed position shown in FIG. 1—spaced apart from one another such that the closure pin 7 is retracted from the closure opening 8 and the sealing end 9 no longer engages into the flow channel 11. However, the discharge nozzle 13 of the chamber 6 and the channel dome 14 of the inner housing 5 are still engaged with one another in this state such that the medium enclosed in the chamber 6 can only flow from the chamber 6 into the container 2 through the flow channel 11. The removal of the sealing end 9 from the closure opening 8 is achieved due to a rotation of the lid element 4 with the chamber 6 arranged thereon relative to the inner housing 5, which in turn is realized by unscrewing the closure device 1 from the container 2.

In the production of the closure device 1 shown, as well as its arrangement on the container 2, the inner housing 5 is initially prepared, for example, by inserting the sealing element 10 into the inner housing 5 such that the channel dome 14 is covered by the sealing element 10. The chamber 6 is subsequently inserted into the inner housing 5 until the closure pin 7 protrudes into the closure opening. The chamber 6 is then filled, sealed with the foil element 12 and connected to the lid element 4. This is the closed position of the closure device 1, in which the medium enclosed in the chamber 6 cannot escape. Subsequently, the closure device 1 can be screwed on the container 2 in order to seal the container opening 3. In this state, the medium enclosed in the container 2 also can no longer escape from the container 2.

In order to discharge the medium stored in the chamber 6 into the container 2, it is necessary to move the closure device 1 into a discharging position. This is achieved by taking hold of the closure device 1 on the lid element 4 and rotating the closure device relative to the container 2 in the usual counterclockwise direction. In this way, the lid element 4 with the chamber 6 arranged thereon is spaced apart from the inner housing 5, which is clamped in the container opening 3. As the chamber 6 is axially spaced apart from the inner housing 5, the closure pin 7 is removed from the closure opening 8 such that the flow channel 11 for the medium from the chamber 6 into the container 2 is opened. As the removal of the lid element 4 from the container 2 continues, the inner housing 5 is ultimately also separated from the container 2 such that the container 2 is now open and the mixed medium can be withdrawn from the container 2.

| List of Reference Symbols | |
|---|---|
| 1 | Closure device |
| 2 | Container |
| 3 | Container opening |
| 4 | Lid element |
| 5 | Inner housing |
| 6 | Chamber |
| 7 | Closure pin |
| 8 | Closure opening |
| 9 | Sealing end |
| 10 | Sealing element |
| 11 | Flow channel |
| 12 | Foil element |
| 13 | Discharge nozzle |
| 14 | Channel dome |
| R | Moving direction |

The invention claimed is:

1. A closure device (1) for closing a container opening (3) of a container (2), particularly a beverage bottle, wherein the closure device (1) comprises a lid element (4), a chamber (6) arranged on the lid element (4) and an inner housing (5), and wherein the chamber (6) and the inner housing (5) comprise closing means and opening means that correspond to one another and interact with one another in such a way that a medium enclosed in the chamber (6) escapes into the container (2) due to a motion of the lid element (4) relative to the inner housing (5), wherein the closing means is a closure pin (7) arranged on the chamber (6) and removable from a closure opening (8) of the inner housing (5) forming the opening means due to a motion of the lid element (4) relative to the inner housing (5), and wherein the opening means comprises an opening part that comprises two circumferential sealing zones, namely a sealing zone that is formed on an outer circumferential surface of the opening means and interacts with an inner surface of the chamber (6) and a sealing zone that is offset inward relative thereto and interacts with the closure pin (7), wherein the sealing zones are furthermore arranged concentric to one another in a direction extending perpendicular to a moving direction (R) of the opening means relative to the chamber (6) when the closure device is opened.

2. A closure device (1) for closing a container opening (3) of a container (2), particularly a beverage bottle, wherein the closure device (1) comprises a lid element (4), a chamber (6) arranged on the lid element (4) and an inner housing (5), and wherein the chamber (6) and the inner housing (5) comprise closing means and opening means that correspond to one another and interact with one another in such a way that a medium enclosed in the chamber (6) escapes into the container (2) due to a motion of the lid element (4) relative to the inner housing (5), wherein the closing means is a closure pin (7), wherein a sealing element (10) is arranged between a sealing end (9) of the closure pin and the closure opening (8), and wherein an additional sealing element is arranged between an inner surface of a discharge nozzle (13) and an outer surface of a channel dome (14) of the inner housing (5) such that two circumferential sealing zones are formed, wherein said sealing zones are arranged concentric to one another in a direction extending perpendicular to a moving direction (R) of the opening means relative to the chamber (6) when the closure device is opened.

3. The closure device (1) according to claim 2, wherein the sealing element (10) is arranged between the sealing end (9) of the closure pin (7) and the closure opening (8).

4. The closure device (1) according to claim 1, wherein the closure pin (7) is realized integrally with the chamber (6).

5. The closure device (1) according to claim 1, wherein the sealing end (9) has a diameter, which essentially corresponds to the inside diameter of the closure opening (8).

6. The closure device (1) according to claim 1, wherein a sealing element (10) is assigned to the closure opening (8) or the closure pin (7) in order to produce a fluid-tight seal between the closure opening (8) and the closure pin (7).

7. The closure device (1) according to claim 6, wherein a sealing element (10) is assigned to the inner wall of the closure opening (8), wherein the inner wall is particularly coated with the sealing material.

8. The closure device (1) according to claim 1, wherein the closure opening (8) forms part of a flow channel (11), the length of which corresponds to at least five times its diameter and to no more than twenty times its diameter.

9. The closure device (1) according to claim 1, wherein the chamber (6) is concentrically arranged in the inner housing (5), wherein the chamber (6) is axially displaced within the inner housing (5) by opening the closure device (1) on the container (2).

* * * * *